US005232354A

United States Patent [19]

Clement

[11] Patent Number: 5,232,354

[45] Date of Patent: Aug. 3, 1993

[54] COMPRESSOR DISCHARGE VALVE ASSEMBLY HAVING PLURAL WAVE RING BIASING MEANS

[75] Inventor: Jack M. Clement, Tecumseh, Mich.

[73] Assignee: Tecumseh Products Company, Tecumseh, Mich.

[21] Appl. No.: 907,604

[22] Filed: Jul. 2, 1992

[51] Int. Cl.[5] ..... F04B 39/10; F16K 15/12

[52] U.S. Cl. ..... 417/569; 417/570; 137/516.23

[58] Field of Search ..... 417/569, 570, 571; 137/516.23, 516.17, 512.15

[56] References Cited

U.S. PATENT DOCUMENTS

| | | | |
|---|---|---|---|
| 2,935,248 | 5/1960 | Gerteis | 230/231 |
| 3,162,360 | 12/1964 | Privon | 230/206 |
| 3,648,722 | 3/1972 | Story | 137/454.4 |
| 4,304,534 | 12/1981 | Meise | 417/569 |
| 4,708,168 | 11/1987 | Peruzzi | 137/543.19 |
| 5,007,807 | 4/1991 | Gannaway | 417/363 |

FOREIGN PATENT DOCUMENTS

| | | | |
|---|---|---|---|
| 72995 | 8/1951 | Fed. Rep. of Germany | 137/512.15 |
| 611202 | 1/1926 | France | 230/184 |

*Primary Examiner*—Richard A. Bertsch
*Assistant Examiner*—Roland McAndrews
*Attorney, Agent, or Firm*—Baker & Daniels

[57] ABSTRACT

A hermetic compressor including a crankcase defining a cylinder. The crankcase has an annular recess formed in the discharge end thereof which defines a shoulder. A cylinder head is disposed over the annular recess. A discharge valve assembly is disposed in the annular recess and includes a valve plate disposed in the annular recess immediately adjacent the shoulder. A valve plate wave ring is disposed at the outlet side of the valve plate and biases the valve plate against the shoulder. A valve leaf disposed radially inward of the first wave ring overlies the discharge ports in the valve plate and has an outlet side facing the cylinder head. A valve leaf wave ring is disposed radially inward of the valve plate wave ring at the outlet side of the valve leaf and biases the valve leaf against the valve plate.

22 Claims, 2 Drawing Sheets

COMPRESSOR DISCHARGE VALVE ASSEMBLY HAVING PLURAL WAVE RING BIASING MEANS

BACKGROUND OF THE INVENTION

1. Field of the invention

The present invention relates to discharge valves, and, more particularly, to discharge valves used in reciprocating compressors.

2. Description of the related art

Compressors of the type to which the present invention pertains comprise a motor-compressor unit mounted within a hermetically sealed housing. The motor-compressor unit includes an electric motor drivingly coupled to a positive displacement reciprocating compressor mechanism for compressing refrigerant. The reciprocating compressor includes a piston driven by the electric motor and slidably carried within a cylinder.

It is known in the art to provide a discharge valve at the discharge end of the cylinder to allow compressed refrigerant to be discharged from the cylinder. Such discharge valves, however, are formed with one or more locating surfaces to properly orient the various flow openings formed in the valve parts, e.g., U.S. Pat. No. 4,027,853 to Linnert; pre-assembled with the various parts fixed to each other in a particular desired orientation, e.g., U.S. Pat. No. 2,935,248 to Gerteis; or include a mulitiplicity of parts, some of which form a housing for the other valve parts and have fluid flow openings therein, e.g., U.S. Pat. No. 4,708,168 to Peruzzi. Such valves tend to be relatively expensive to manufacture and/or assemble.

What is needed in the art is a discharge valve which may be easily assembled in the compressor at the discharge end of the cylinder without any pre-assembly, and which does not require any particular orientation for proper operation of the valve.

SUMMARY OF THE INVENTION

The present invention provides a discharge valve disposed at the discharge end of a compressor cylinder including a valve plate, valve leaf and first and second wave rings which interfit and coact to provide easy assembly.

The invention comprises, in one form thereof, a hermetic compressor including a crankcase defining a cylinder. The crankcase has an annular recess formed in the discharge end thereof which defines a shoulder. A cylinder head is disposed over the annular recess. A discharge valve assembly is disposed in the annular recess and includes: A valve plate disposed in the annular recess immediately adjacent the shoulder. The valve plate has one or more discharge ports and an outlet side facing the cylinder head. A valve plate wave ring is disposed at the outlet side of the valve plate and biases the valve plate against the shoulder. A valve leaf disposed radially inward of the first wave ring overlies the discharge ports. The valve leaf has an outlet side facing the cylinder head. A valve leaf wave ring is disposed radially inward of the valve plate wave ring at the outlet side of the valve leaf and biases the valve leaf against the valve plate.

In another form of the invention, the valve plate is formed with a centrally located projection and the valve leaf is formed with a centrally located opening. The projection matingly engages the opening and thereby positions the valve leaf in the annular recess.

The projection may be formed by coining a recess on the side of the valve plate opposite the projection.

An advantage of the present invention is that the various parts of the discharge valve interfit with each other to locate the respective discharge valve parts relative to each other.

Another advantage is that the various valve parts do not require a particular circumferential orientation for proper alignment.

Yet another advantage is the wave rings bias and maintain the valve plate and valve leaf in a proper position.

Still another advantage is that the wave rings are resilient in an axial direction and thereby accommodate tolerance stack up of the valve plate, valve leaf and annular recess formed in the crankcase.

A still further advantage is that manufacturing and assembly costs are reduced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
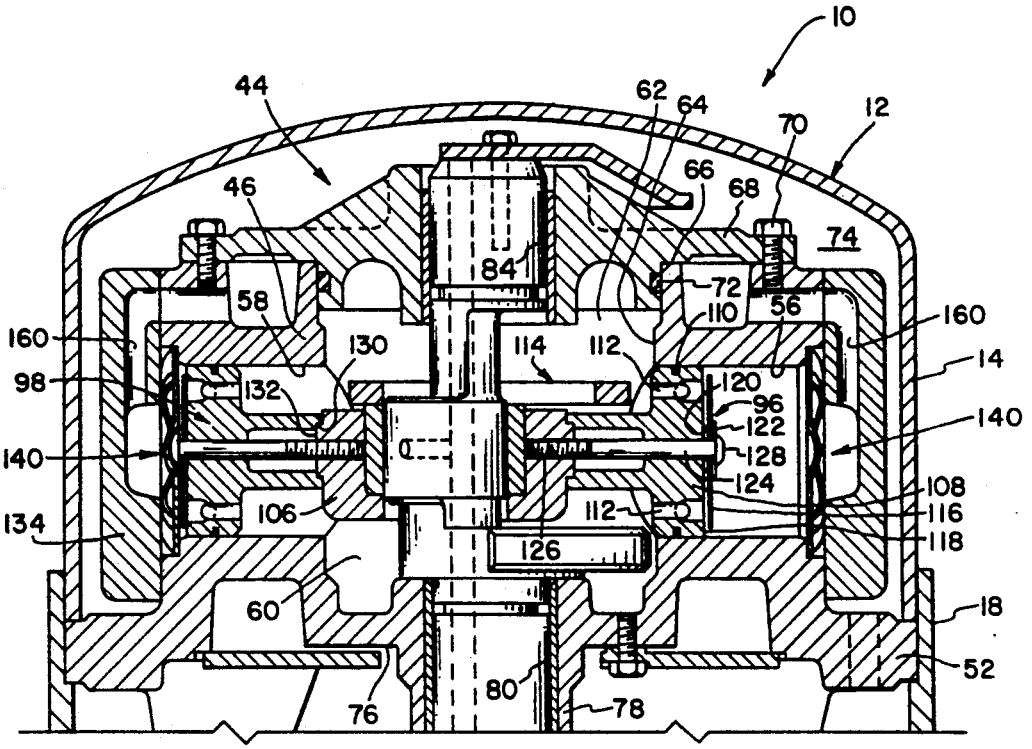
FIG. 1 is a partial sectional view of a hermetic compressor including discharge valves according to the present invention.

Referring now to the drawings and particularly to FIG. 1, there is shown a motor-compressor unit 10 mounted within a hermetically sealed housing 12. Such a motor-compressor is described in detail in U.S. Pat. No. 5,007,807 to Gannaway, which is assigned to the assignee of the present invention and incorporated herein by reference.

Housing 12 has a top portion 14 and a bottom portion 18. The two housing portions 12 and 14 are hermetically secured together as by welding or brazing. The motor includes a stator provided with windings 28, and a rotor having a central aperture provided therein into which is secured a crankshaft by an interference fit. A terminal cluster is provided in bottom portion 18 of housing 12 for connecting the motor-compressor to a source of electric power.

Also enclosed within housing 12 is a compressor mechanism generally designated at 44. Compressor mechanism 44 comprises a crankcase 46 including a circumferential mounting flange 52 supported within housing 12. Compressor mechanism 44 takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an O-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing 80. Likewise, a sleeve bearing 84 is provided in cage bearing 68, whereby sleeve bearings 80 and 84 are in axial alignment. Sleeve bearings 80 and 84 are manufactured from steel-backed bronze.

Piston assemblies 96 and 98 each comprise a piston member 108 having an annular piston ring 110 to allow piston member 108 to reciprocate within a cylinder to compress gaseous refrigerant therein. Suction ports 112 extending through piston member 108 allow suction gas within suction cavity 60 to enter cylinder 56 on the compression side of piston 108.

A suction valve assembly 114 is also associated with each piston assembly, and will now be described with respect to piston assembly 96 shown in FIG. 1. Suction valve assembly 114 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122 made of spring steel.

As illustrated in FIG. 1, valve retainer 122, suction valve 116, and guide member 120 are secured to top surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a supplementary boss 132 is provided on the corresponding yoke member, whereby boss 132 is received within recess 130 to promote positive, aligned engagement therebetween.

Compressed gas refrigerant within each cylinder is discharged through a discharge valve assembly 140 to which the present invention is specifically directed. Discharge valve assembly 140 is disposed at the discharge end of each of the four cylinders in compressor 44. However, for purposes of illustration, only the discharge valve assembly 140 disposed at the discharge end of cylinder 56 will be particularly described. Discharge valve assembly 140 generally includes a valve plate 142, valve plate wave ring 144, valve leaf 146 and valve leaf wave ring 148.

A cylinder head 134 is mounted to crankcase 46 at the discharge end 141 thereof with discharge valve assembly 140 interposed therebetween in a retainer means 162 disposed at the discharge end of cylinder 56. Retainer means 162 is an annular recess 164 formed in crankcase 46 defining a shoulder 166. In an alternative embodiment (not shown), retainer means 162 could be formed by a recess in cylinder head 134.

The term "inlet side", as referred to in this application, is defined as the side of the specifically referred to part which is closest to cylinder 56; and, the term "outlet side", as referred to in this application, is defined as the side of the specifically referred to part which is closest to cylinder head 134.

Figure 2:
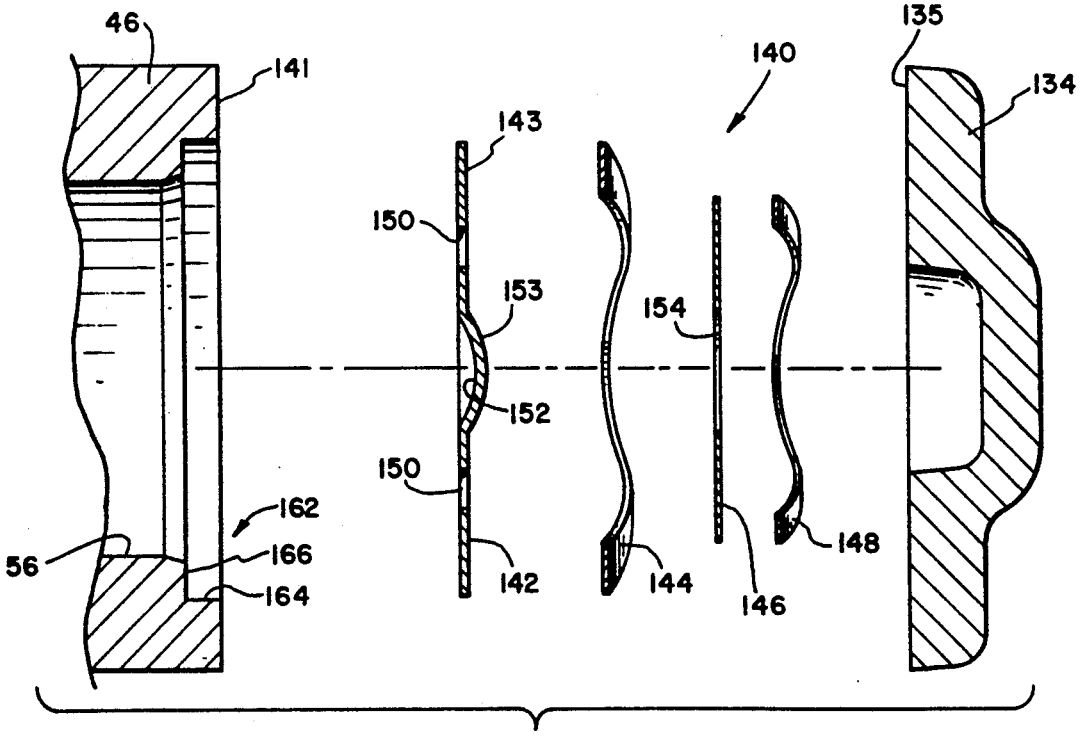
FIG. 2 is a fragmentary exploded view of the compressor and improved discharge valve shown in FIG. 1.
Figure 4:
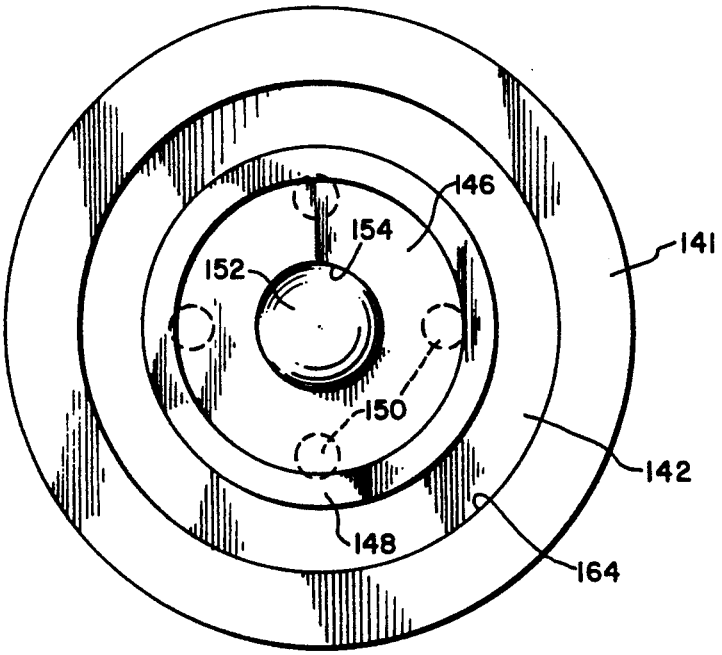
FIG. 4 is a sectional view taken at section line 4—4 in FIG. 3.

Valve plate 142 is formed as a metal stamping or of powdered metal and includes a plurality of discharge ports 150 allowing compressed gas to be discharged from cylinder 56. Valve plate 142 includes a coined recess 152 into which buttonhead 128 of threaded bolt 124 is received when piston assembly 96 is positioned at top dead center (TDC). As is apparent in FIG. 2, coined recess 152 forms a projection 153 at the opposing side of valve plate 142. The plurality of discharge ports 150 are disposed radially outward of coined recess 152. In the embodiment shown, valve plate 142 is formed with four discharge ports (FIG. 4).

Valve plate wave ring 144 preferably has a maximum diameter about the same as the maximum diameter of valve plate 142 and a minimum diameter sufficient to allow refrigerant flow through the discharge ports 150 formed in valve plate 142, i.e., valve plate wave ring 144 does not substantially extend over discharge ports 150 and thereby inhibit refrigerant flow through discharge ports 150. Valve plate wave ring 144 is formed from a resilient material such as spring steel having a number of "waves" adapted to bias valve plate 142 against shoulder 166. That is, valve plate wave ring 144 has a total thickness when in a relaxed position which is slightly greater than the distance between the outlet side 143 of valve plate 142 and the under surface 135 of cylinder head 134, thereby effectively biasing valve plate 142 against shoulder 166 when cylinder head 134 is fixed to crank case 46.

Figure 3:
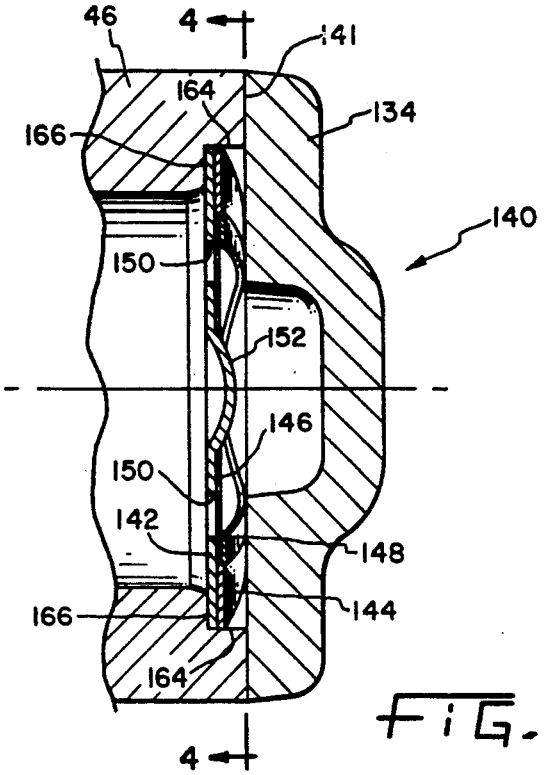
FIG. 3 is a fragmentary side sectional view of the compressor and discharge valve shown in FIG. 1.

Disposed radially inward of valve plate wave ring 144 and having a maximum diameter preferably just slightly less than the minimum diameter of the valve plate wave ring 144 is an annular valve leaf 146. Valve leaf 146 includes a central opening 154 which is slightly larger than the diameter of protrusion 153 at the discharge side of valve plate 142. Thus, valve leaf 146 is disposed immediately adjacent to discharge ports 150 formed in valve plate 142 (FIG. 3). Valve leaf 146 is maintained in an orientation by both the valve plate wave ring 144 and the projection 153. However, in an alternative embodiment not having a projection 153 formed in valve plate 142 (not shown), valve plate wave ring 144 sufficiently maintains valve leaf 146 in a proper position.

Disposed above valve leaf 146 is a valve leaf wave ring 148. Valve leaf wave ring 148 has a maximum diameter about the same as valve leaf 146 and is disposed radially inward of valve plate wave ring 144 (FIG. 3). Valve leaf wave ring 148 has a minimum or inside diameter which is about the same as or slightly less than the distance from outside to outside of discharge ports 150 (FIGS. 3 and 4). As with valve plate wave ring 144, valve leaf wave ring 148 is formed from a resilient material such as spring steel and is adapted to bias valve leaf 146 against valve plate 142 when cylinder head 134 is fixed in place on crankcase 46. Valve plate wave ring 144 and valve leaf wave ring 148 are adjustable in an axial direction, because of the resilient material, and thereby accommodate axial tolerances of the annular recess 164, valve plate 142 and valve leaf 146. Moreover, the number of waves formed in valve leaf wave ring 148 is different from the number of waves formed in valve plate wave ring 144, thereby further assuring valve leaf wave ring 148 is circumferentially located radially inward of valve plate wave ring 144.

Assembly of discharge valve assembly 140 at the discharge end of each cylinder is accomplished as follows: Valve plate 142 is placed into the annular recess 164 formed in crankcase 46 against shoulder 166. Valve plate wave ring 144 is then placed in recess 164 against valve plate 144 at the outlet side thereof. Valve leaf 146 is then placed radially inward from valve plate wave ring 144 at the outlet side of valve plate 142. Valve leaf wave ring 148 is then placed radially inward of valve plate wave ring 144 and against valve leaf 146. Cylinder head 134 is then placed over the discharge valve assembly 140 and fixed to crankcase 46. Attachment of cylinder head 134 causes valve plate wave ring 144 and valve leaf wave ring 148 to be slightly compressed in thickness, thereby respectively biasing valve plate 142 against shoulder 166 and valve leaf 146 against valve plate 142. Because the plurality of parts including valve plate 142, valve plate wave ring 144, valve leaf 146 and valve leaf wave ring 148 are generally annular shaped and because discharge ports 150 are radially disposed about projection 153, no particular circumferential orientation is required for proper functioning of discharge valve assembly 140.

In operation, gas is compressed within cylinder 56 by piston 108. The pressurized gas flows through the plurality of discharge ports 150 and exerts a force against valve leaf 146 disposed immediately adjacent thereto. Valve leaf 146 rises and/or bends because of the gas pressure and the gas is allowed to flow between valve plate 142 and valve leaf 146 and through central opening 154 formed in valve leaf 146. The compressed exhaust gas then flows through the cylinder head 134 and out through a discharge port 160 formed therein.

The present invention reduces assembly time and associated costs because the parts are not required to be oriented in a particular manner to achieve proper functioning of the discharge valve assembly 140. Moreover, the four parts forming the discharge valve assembly 140 interact with each other to locate and position the respective parts within the annular recess 164 formed at the discharge end of each cylinder, thereby further reducing assembly time and costs.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic compressor, comprising:

a crankcase defining a cylinder, said crankcase having an annular recess formed in the discharge end thereof which defines a shoulder;

a cylinder head disposed over said annular recess;

a discharge valve assembly disposed in said annular recess, said discharge valve assembly including:

a valve plate disposed in said annular recess immediately adjacent said shoulder, said valve plate having one or more discharge ports and an outlet side facing said cylinder head;

a valve plate wave ring disposed at the outlet side of said valve plate and biasing said valve plate against said shoulder;

a valve leaf disposed radially inward of said first wave ring and overlying said discharge ports, said valve leaf having an outlet side facing said cylinder head, said valve leaf directly located radially by means of said valve plate wave ring; and a valve leaf wave ring disposed radially inward of said valve plate wave ring at the outlet side of said valve leaf, said valve leaf wave ring biasing said valve leaf against said valve plate.

2. The compressor of claim 1 wherein the compressor includes a crankcase defining four cylinders, each cylinder including an annular recess at the discharge end thereof, and four cylinder heads, each annular recess adapted to receive a respective discharge valve assembly.

3. The compressor of claim 1 wherein said valve leaf wave ring movably biases said valve leaf against said valve plate.

4. The compressor of claim 1 wherein said valve plate wave ring and said valve leaf wave ring comprise a different number of waves.

5. The compressor of claim 4 wherein said valve plate wave ring is adapted to bias said valve plate against said shoulder and said valve leaf wave ring is adapted to bias said valve leaf against said valve plate when the cylinder head is fixed to said crankcase.

6. A discharge valve assembly in a hermetic compressor having a crankcase defining a cylinder, and a cylinder head, said discharge valve assembly comprising:

retaining means disposed at the discharge end of the cylinder for retaining said discharge valve assembly, said retaining means defining a shoulder;

a valve plate rotatably disposed in said retaining means immediately adjacent said shoulder, said valve plate having one or more discharge ports and an outlet side facing said cylinder head;

a valve plate wave ring rotatably disposed at the outlet side of said valve plate and biasing said valve plate against said shoulder;

a valve leaf rotatably disposed radially inward of said first wave ring and overlying said discharge ports, said valve leaf having an outlet side facing said cylinder head, said valve leaf directly located radially by means of said valve plate wave ring; and a valve leaf wave ring rotatably disposed radially inward of said valve plate wave ring at the outlet side of said valve leaf, said valve leaf wave ring biasing said valve leaf against said valve plate.

7. The compressor of claim 6 wherein the compressor includes a crankcase defining four cylinders, each cylinder including a retaining means comprising an annular recess at the discharge end thereof, and four cylinder heads, each annular recess adapted to receive a respective discharge valve assembly.

8. The compressor of claim 6 wherein said valve leaf wave ring movably biases said valve leaf against said valve plate.

9. A discharge valve assembly in a hermetic compressor having a crankcase defining a cylinder, and a cylinder head, said discharge valve assembly comprising:

retaining means disposed at the discharge end of the cylinder for retaining said discharge valve assembly, said retaining means defining a shoulder;

a valve plate disposed in said retaining means immediately adjacent said shoulder, said valve plate having one or more discharge ports and an outlet side facing said cylinder head;

a valve plate wave ring disposed at the outlet side of said valve plate and biasing said valve plate against said shoulder;

a valve leaf disposed radially inward of said first wave ring and overlying said discharge ports, said valve leaf having an outlet side facing said cylinder head; and a valve leaf wave ring disposed radially inward of said valve plate wave ring at the outlet side of said valve leaf, said valve leaf wave ring biasing said valve leaf against said valve plate, said valve plate wave ring and said valve leaf wave ring having a different number of waves.

10. The compressor of claim 9 wherein said valve plate wave ring is adapted to bias said valve plate against said shoulder and said valve leaf wave ring is adapted to bias said valve leaf against said valve plate when the cylinder head is fixed to said crankcase.

11. A hermetic compressor, comprising:

a crankcase defining a cylinder, said crankcase having an annular recess formed in the discharge end thereof which defines a shoulder;

a cylinder head disposed over said annular recess;

a discharge valve assembly disposed in said annular recess, said discharge valve assembly including:

a valve plate disposed in said annular recess immediately adjacent said shoulder, said valve plate having one or more discharge ports and an outlet side facing said cylinder head, said valve plate formed with a centrally located projection;

a valve plate wave ring disposed at the outlet side of said valve plate and biasing said valve plate against said shoulder;

a valve leaf disposed radially inward of said first wave ring and overlying said discharge ports, said valve leaf having an outlet side facing said cylinder head, said valve leaf formed with a centrally located opening, said projection matingly engaging said opening and thereby positioning said valve leaf in said annular recess; and a valve leaf wave ring disposed radially inward of said valve plate wave ring at the outlet side of said valve leaf, said valve leaf wave ring biasing said valve leaf against said valve plate.

12. The compressor of claim 11 wherein said projection is formed by forming a recess on the side of said valve plate opposite said projection.

13. The compressor of claim 11 wherein said projection is dome shaped.

14. The compressor of claim 13 wherein said circular opening formed in said valve leaf has a diameter slightly larger than the diameter of said projection.

15. The compressor of claim 13 wherein four discharge ports are equidistantly formed in said valve plate radially outward from said projection.

16. A discharge valve assembly in a hermetic compressor having a crankcase defining a cylinder, and a cylinder head, said discharge valve assembly comprising:

retaining means disposed at the discharge end of the cylinder for retaining said discharge valve assembly, said retaining means defining a shoulder;

a valve plate disposed in said retaining means immediately adjacent said shoulder, said valve plate having one or more discharge ports and an outlet side facing said cylinder head;

a valve plate wave ring disposed at the outlet side of said valve plate and biasing said valve plate against said shoulder; said valve plate formed with a centrally located projection;

a valve leaf disposed radially inward of said first wave ring and overlying said discharge ports, said valve leaf having an outlet side facing said cylinder head, said valve leaf formed with a centrally located opening, said projection matingly engaging said opening and thereby positioning said valve leaf in said retaining means; and a valve leaf wave ring disposed radially inward of said valve plate wave ring at the outlet side of said valve leaf, said valve leaf wave ring biasing said valve leaf against said valve plate.

17. The compressor of claim 16 wherein said projection is formed by coining a recess on the side of said valve plate opposite said projection.

18. The compressor of claim 17 wherein said projection is dome shaped.

19. The compressor of claim 18 wherein said circular opening formed in said valve leaf has a diameter slightly larger than the diameter of said projection.

20. The compressor of claim 19 wherein four discharge ports are equidistantly formed in said valve plate radially outward from said projection.

21. A method of assembling a discharge valve in a reciprocating compressor having a crankcase defining a cylinder, a cylinder head, and a retaining means defining a shoulder for retaining the discharge valve, the retaining means interposed between the cylinder and cylinder head, comprising the steps of:

disposing a valve plate in the retaining means against the shoulder, said valve plate having one or more discharge ports and an outlet side facing the cylinder head;

disposing a valve plate wave ring in the retaining means against the outlet side of said valve plate;

disposing a valve leaf against the outlet side of said valve plate radially inward of said valve plate wave ring and over said one or more outlet ports, said valve leaf having an outlet side facing the cylinder head;

disposing a valve leaf wave ring at the outlet side of said valve leaf and radially inward of said valve plate wave ring; and fixing a cylinder head to said crankcase over said valve plate, valve plate wave ring, valve leaf wave ring and valve leaf.

22. The method of claim 21 wherein said retaining means is a recess formed at the discharge end of the crankcase in the interior cylinder wall, said recess defining a shoulder and having a diameter larger than said interior cylinder wall.

* * * * *